US011237502B2

(12) United States Patent
Maister et al.

(10) Patent No.: US 11,237,502 B2
(45) Date of Patent: Feb. 1, 2022

(54) CALIBRATION OF A TEMPERATURE SENSOR OF A PRINTING DEVICE

(71) Applicant: Hewlett-Packard Development Company, L.P., Spring, TX (US)

(72) Inventors: Dmitry Maister, Ness Ziona (IL); Michel Assenheimer, Ness Ziona (IL); Liran Fanny Haim, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/982,074

(22) PCT Filed: May 11, 2018

(86) PCT No.: PCT/US2018/032383
§ 371 (c)(1),
(2) Date: Sep. 18, 2020

(87) PCT Pub. No.: WO2019/216918
PCT Pub. Date: Nov. 14, 2019

(65) Prior Publication Data

US 2021/0109462 A1 Apr. 15, 2021

(51) Int. Cl.

| | |
|---|---|
| ***G03G 15/16*** | (2006.01) |
| ***G03G 15/24*** | (2006.01) |
| ***G03G 15/00*** | (2006.01) |
| ***G03G 21/20*** | (2006.01) |

(52) U.S. Cl.
CPC ..... *G03G 15/161* (2013.01); *G03G 15/168* (2013.01); *G03G 15/169* (2013.01); *G03G 15/1695* (2013.01); *G03G 15/24* (2013.01); *G03G 15/5045* (2013.01);
(Continued)

(58) Field of Classification Search
CPC ..... G03G 15/161; G03G 15/24; G03G 15/55; G03G 21/20; G03G 15/168; G03G 15/169; G03G 15/1695; G03G 15/5045; G03G 15/5054
See application file for complete search history.

(56) References Cited

U.S. PATENT DOCUMENTS

| | | | |
|---|---|---|---|
| 4,386,360 | A | 5/1983 | Murayama et al. |
| 5,519,644 | A | 5/1996 | Benton |
| 5,745,132 | A | 4/1998 | Hirabayashi et al. |

(Continued)

FOREIGN PATENT DOCUMENTS

| | | | |
|---|---|---|---|
| EP | 0601658 | B1 | 3/1997 |
| EP | 1431045 | A1 | 6/2004 |

*Primary Examiner* — Joseph S Wong
(74) *Attorney, Agent, or Firm* — Trop Pruner & Hu PC

(57) ABSTRACT

A printing device having a heating apparatus arranged to heat an image substrate, a temperature sensor associated with the image substrate, and a processor communicatively coupled to the heating apparatus. During a simulation mode of the printing device, the processor determines the heating power of the heating apparatus, predicts a temperature of the image substrate based on the heating power, compares the predicted temperature to a measured temperature of the image substrate by the temperature sensor, determines a calibration offset when the measured temperature deviates from the predicted temperature, and selectively generates a control signal for use in calibrating the temperature sensor based on the calibration offset.

20 Claims, 7 Drawing Sheets

(52) U.S. Cl.
CPC ..... *G03G 15/5054* (2013.01); *G03G 15/55* (2013.01); *G03G 21/20* (2013.01)

(56) References Cited

U.S. PATENT DOCUMENTS

| | | | | |
|---|---|---|---|---|
| 5,992,979 | A | 11/1999 | Barbour et al. | |
| 5,999,768 | A | 12/1999 | Gillen et al. | |
| 6,505,557 | B2 | 1/2003 | Desaulniers et al. | |
| 6,708,279 | B1 | 3/2004 | Takenaka | |
| 7,607,746 | B2 | 10/2009 | Koehler et al. | |
| 7,901,130 | B2 | 3/2011 | Limb et al. | |
| 8,063,925 | B2 | 11/2011 | Tainer et al. | |
| 2007/0242951 | A1* | 10/2007 | Van Sas ..... | G03G 15/2032 396/575 |
| 2008/0025734 | A1* | 1/2008 | Kehoe ..... | G03G 15/55 399/8 |

* cited by examiner

CALIBRATION OF A TEMPERATURE SENSOR OF A PRINTING DEVICE

BACKGROUND

Printers, such as liquid electrophotographic printers (LEP), form images on print media. To do so, a liquid electrophotographic printer may place a uniform electrostatic charge on an imaging element, such as a photo imaging plate (PIP), and then selectively discharge the imaging element to form a latent electrostatic image. A printing fluid is then applied to the latent image on the photo imaging plate and attracted to the partially discharged surface, thereby creating an inked image on the photo imaging plate.

The inked image may then be transferred on to a transfer member, such as an image transfer blanket on an intermediate transfer member (ITM). From the transfer member, the inked image is transferred onto print media.

BRIEF DESCRIPTION OF THE DRAWINGS

Various features of the present disclosure will be apparent from the detailed description which follows, taken in conjunction with the accompanying drawings, which together illustrate, features of the present disclosure, and wherein.

DETAILED DESCRIPTION

Figure 1:
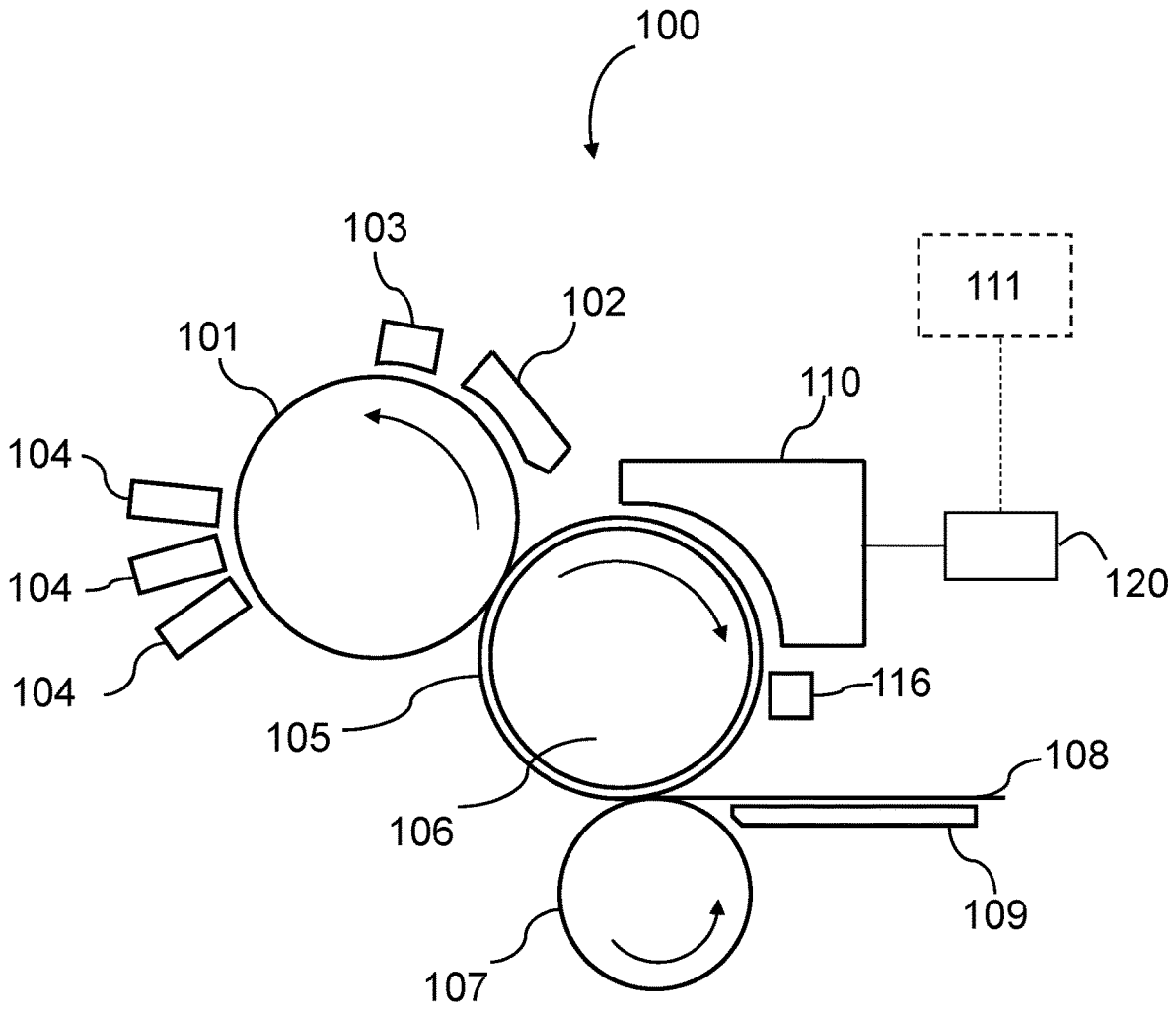
FIG. 1 is a schematic diagram of a printing device, according to an example.

In an example printing device, an inked image on a transfer member, such as an image transfer blanket on an intermediate transfer member drum, may be heated by a heater so that the colourants of the printing fluid fuse together and one or more components of the printing fluid, such as a solvent of the printing fluid, are evaporated. The resulting image layer on the transfer member is then transferred to print media, for example a sheet of paper. In a variation to the herein described examples, the intermediate transfer member may be an intermediate transfer belt, or other means with a surface able to be rotated to receive an inked image form a photo imaging plate and subsequently, transfer the inked image to print media.

The heater may be in the form of an internal heater of the transfer member, an external heater of the transfer member, or both. In one example, an internal heater heats the intermediate transfer member drum, which causes heating of the underside of the image transfer blanket. That is, an internal heater indirectly heats the image transfer blanket. In one example, an external heater heats the outer surface of the image transfer blanket that is in contact with the inked image. That is, an external heater directly heats the image transfer blanket. Accordingly, each of an internal heater and an external heater cause heating of the image transfer blanket. In one example, the surface of the image transfer blanket is heated to a temperature that allows the evaporation and fusion of components of the printing fluid, as described above.

The image transfer blanket and intermediate transfer drum may each be considered as an image substrate because the inked image is directly formed on the image transfer blanket and indirectly formed on the intermediate transfer drum. In another example, the image transfer blanket and the intermediate transfer drum may together be considered an image substrate.

The heating of an image substrate on which an inked image is formed, such as the transfer member, by a heater may be controlled in a feedback loop including a temperature sensor that measures the temperature of the image substrate. The heat transmitted by the heater is driven by a temperature measured by the temperature sensor and a set-point temperature.

During printing, the heating power input to a heating apparatus may vary widely due to rapidly changing input conditions, for example, different types of print media, varying ink coverage in an inked image, and different printing modes. Therefore, a feedback loop based on temperature may be used over a feedback loop based on heating power.

However, during use of the printing device, dirt may accumulate on the temperature sensor, the field of view of the temperature sensor may become partially blocked, and the temperature sensor may experience signal drift.

In one example, the window of the temperature sensor may be contaminated. In this case, part of the infrared energy incident on the window is absorbed in the contamination layer and the temperature sensor measures a lower signal, which is interpreted as a lower temperature. In another example, if the field of view is partially obstructed or blocked, less energy arrives for a given target temperature at the sensing surface of the temperature sensor. The temperature sensor will generate a temperature signal that is lower than that of the surface to be measured. In some sense the sensor assumes there is no obstruction of the field of view.

Accordingly, the temperature sensor may malfunction causing readings by the temperature sensor to become inaccurate.

Inaccurate temperature readings may cause the actual temperature of the image substrate to be higher than the measured temperature, resulting in components of the printer, such as the image substrate, to be continuously and significantly overheated above the desired set point temperature. Overheating of printer components reduces their long-term performance. This causes degradation in printing quality and will dramatically shorten the lifespan of the printer components.

Similarly, inaccurate temperature readings may cause the actual temperature of the image substrate to be lower than the measured temperature, resulting in insufficient heating of the image substrate. Insufficient heating of the image substrate may result in a reduction in print quality due to the printing fluid not being properly fixed in place on the print media.

Accordingly, to avoid these issues, an example printing device as described herein provides a way of calibrating a temperature sensor.

An example printing device comprises a heating apparatus arranged to heat an image substrate, a temperature sensor associated with the image substrate, and a processor communicatively coupled to the heating apparatus. During a simulation mode of the printing device, the processor is configured to: determine the heating power of the heating apparatus, predict a temperature of the image substrate based on the heating power, compare the predicted temperature to a measured temperature of the image substrate by the temperature sensor, determine a calibration offset when the measured temperature deviates from the predicted temperature, and selectively generate a control signal for use in calibrating the temperature sensor based on the calibration offset. In one example, the control signal may be generated when the printing device is not in the simulation mode.

The heating power of the heating apparatus may be the power of an input (or a proxy thereof) to the heating apparatus. In another example, the heating power may be power output (or a proxy thereof) by the heating apparatus.

The example printing device can proactively calibrate the temperature sensor using heating power without having to rely on a diagnosis of the performance of the temperature sensor based on poor print quality and/or on degradation of the component lifespan to prompt calibration of the temperature sensor.

In this way, the example printing device provides accurate calibration of the temperature sensor that reduces the likelihood of the printing device experiencing consequences of sensor malfunction, such as a significant impact to printing quality and/or component lifespan, due to application of a correction to readings of the temperature sensor.

In current systems, field support engineers perform a troubleshooting operation and consequent temperature sensor calibration using an additional external temperature sensor to eliminate the possibility of the effects (such as the effects of reduced printing quality and reduced component lifespan) being associated with the temperature control system and/or validate the accuracy of the temperature sensor of the printing device. Additionally, a service or support engineer, and/or operator, also relies on previously identified print quality outputs for a specific application of the printing device to validate the accuracy of the temperature sensor of the printing device. The use of an additional temperature sensor is complicated because the architecture of a printing device does not allow for a comparison to be made between readings from both sensors in the same location whilst the device is printing. In addition, such a calibration process involves high skill, additional equipment and wastes printing device time. Consequently, field engineers often replace an intact temperature sensor rather than calibrating the sensor.

Due to the proactive nature of the example printing device, the costs associated with service calls, support engineers, and sensor replacements that are inherent in current systems can be reduced.

In more detail, the printing device is proactive (by identifying a calibration offset and selectively generating a control signal before a significant reduction in print quality or a significant reduction in lifespan of a component occurs). Time of a field engineer is saved because an automatic calibration of a temperature sensor is carried out, so less time is spent troubleshooting. Cost of support engineers is reduced because skill level is reduced (less troubleshooting due to automatic calibration). Number of service calls is reduced because proactive action can be taken.

An example printing device 100 is depicted in FIG. 1. According to the example of FIG. 1, in use, a photo imaging plate (PIP) 101 is rotated under a charging system 102. In this example, the photo imaging plate 101 is cylindrical and constructed in the form of a drum. The charging system 102 places a uniform electrostatic charge on the photo imaging plate 101 (also referred to as a "photoreceptor"). The charging system 102 may include a charging device, such as corona wire, a charge roller, or any other charging device.

As the photo imaging plate 101 continues to rotate, it passes a writing head 103 where one or more laser beams dissipate localized charge in selected portions of the photo imaging plate 101 to leave an invisible electrostatic charge pattern that corresponds to the image to be printed, i.e. a latent image.

Next, printing fluid, such as ink, is transferred onto the photo imaging plate 101 by at least one image development unit 104 (also referred to as a binary ink developer unit). There may be an image development unit 104 for each ink colour. During printing, the appropriate image development unit 104 is engaged with the photo imaging plate 101. The engaged image development unit 104 presents a uniform film of ink to the photo imaging plate 101. The electrically-charged ink particles are attracted to the opposing charges on the image areas of the photo imaging plate 101 ("zero transfer").

The ink may be a liquid toner, comprising ink particles and a carrier liquid. The carrier liquid may be a dielectric fluid such as an oil. An example liquid toner ink is HP ElectroInk. In this case, pigment particles are incorporated into a resin that is suspended in a carrier liquid, such as isoparaffin solvents.

Returning to the printing process, the photo imaging plate 101 continues to rotate and the inked image is transferred to an image substrate, such as intermediate transfer member drum (ITM) 106 ("first transfer"). In this example, an image transfer blanket 105 resides on the outer surface of the ITM 106. The ITM 106 rotates in a direction opposite to that of the photo imaging plate 101.

Once transferred to the ITM 106, the printing fluid of the inked image is heated by a heating apparatus 110 as the ITM 106 rotates. In the example of FIG. 1, the depicted heating apparatus, heating apparatus 110, is an external heater that heats the surface of the image transfer blanket 105. The heating apparatus 110 may be at least one heat lamp, such as at least one Infra-Red heating lamp. In other examples, the heating apparatus 110 may be an internal heater of the ITM 106 and image transfer blanket 105. For example, an internal heat lamp. In a further example, the heating apparatus may be at least one external heater and at least one internal heater. For example, the heating apparatus may be at least one internal heat lamp and at least one external heat lamp. In another example, the printing device 100 may comprise a second heating apparatus that works in combination with the heating apparatus 110. For example, the second heating apparatus may cause heating by provided hot air streams. In a scenario where the heating apparatus comprises more than one heater (internal or external) each heater may be independently associated with corresponding temperature sensors and, consequently, be controlled independently. Alternatively, each heater may be associated with the same temperature sensor and, consequently, controlled together.

The heating apparatus 110 heats the inked image on the image transfer blanket 105 so that the colourants of the printing fluid fuse together and one or more components of the printing fluid, such as a solvent of the printing fluid, are evaporated. In one example, the printing fluid is a carrier.

A temperature sensor 116 is associated with the image transfer blanket 105 and measures the surface temperature of the image transfer blanket 105. In the example of FIG. 1, the temperature sensor 116 is positioned so that the sensor 116 can measure the temperature of the image transfer blanket 105. In this example, the sensor 116 is a non-contact temperature sensor positioned adjacent the image transfer blanket 105. In another example, the temperature sensor 116 may be in direct contact with the image transfer blanket.

The temperature sensor 116 is part of a calibration loop (discussed below, with reference to FIG. 3) that acts as both a feedback loop to control the heating power of the heating apparatus 110 and a calibration loop to calibrate the temperature sensor 116. In this example, the temperature sensor 116 is an Infra-Red temperature sensor, such as an Infra-Red thermometer, that converts incident Infra-Red radiation into an electrical signal. Other examples of temperature sensors that may be used are: a thermistor-based sensor, a resistor-based sensor, a thermocouple, a thermochromic sensor, a semiconductor-based sensor, and a sensor that senses a temperature-dependent physical property.

Figure 2:
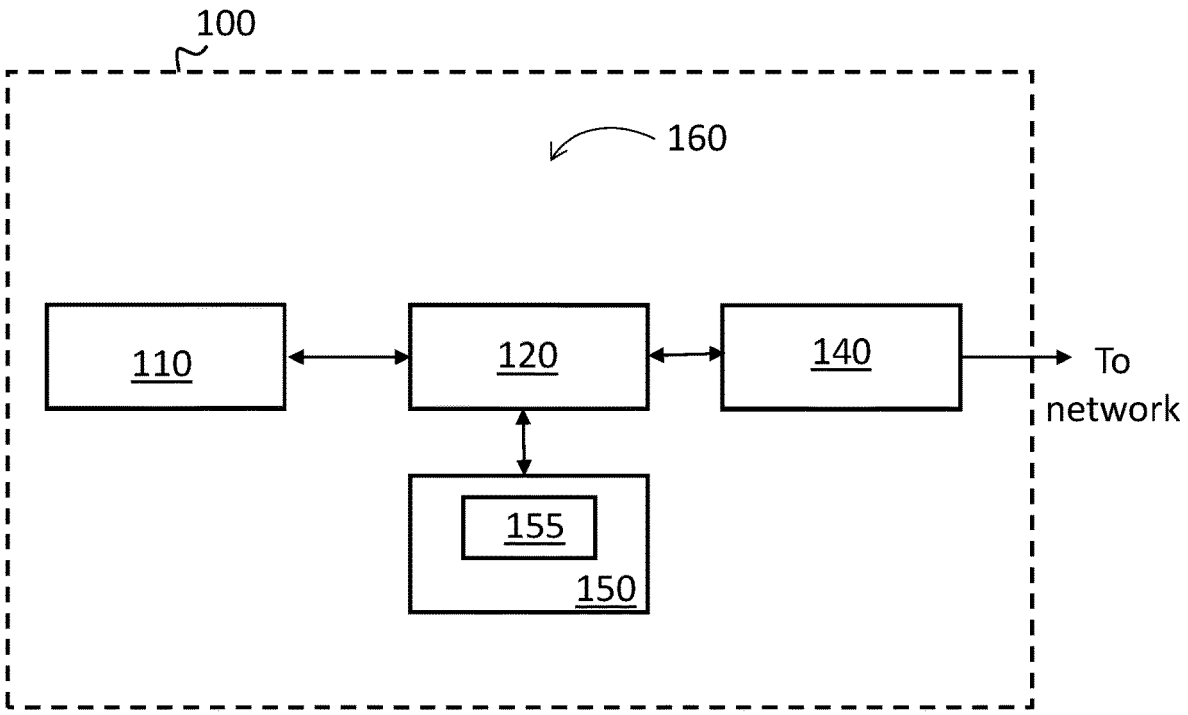
FIG. 2 is a block diagram of device circuitry of the printing device of FIG. 1, according to an example.
Figure 3:
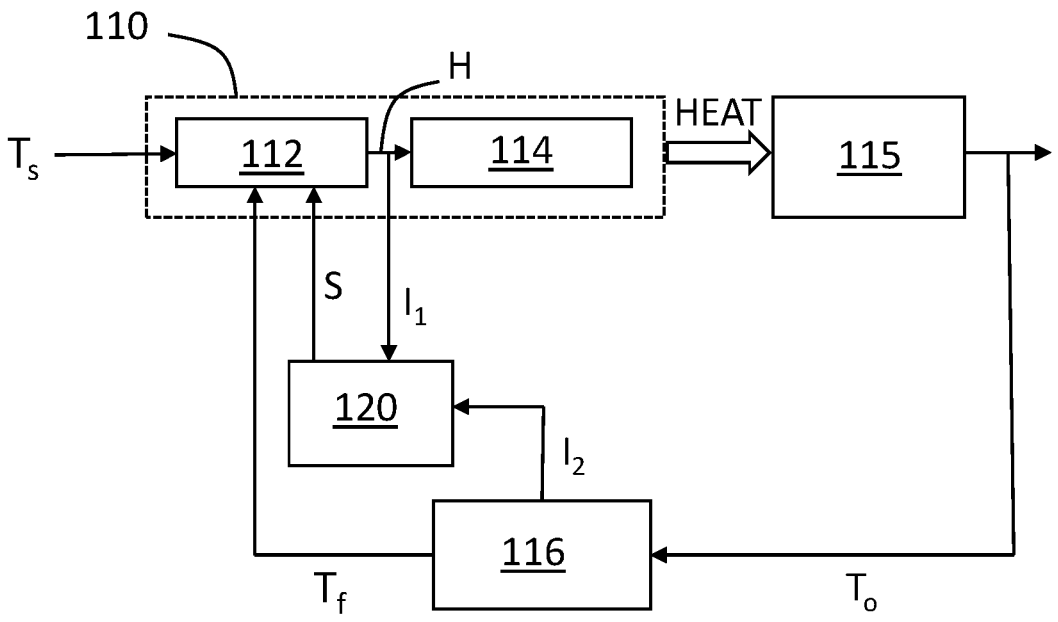
FIG. 3 is a block diagram of a calibration loop of the printing device of FIGS. 1 and 2, according to an example.

A processor 120 is communicatively coupled to the heating apparatus 110 (described in more detail in relation to FIGS. 2 and 3). The processor 120 executes instructions 111 that cause the later-described methods 200, 290, and 300 to be implemented.

After heating, the resultant image layer is guided between a surface of an impression roll 107 and the surface of the image blanket 105 so that the image layer is transferred onto a print media 108 ("second transfer"). In this example, the print media 108 is supported by a media substrate 109 as the print media 108 is guided between the impression roll 107 and the image blanket 105. In one example, the print media 108 may be a cut-sheet of paper, whereby, the printing device 100 performs sheet-fed printing. In such an example, the print media may be held in place on the surface of the impression roll 107 by a fastening means (not shown). Alternatively, the print media 108 may be in the form of a continuous roll, whereby the printing 100 device performs web printing. The print media 108 may partially wrap around the impression roll 107.

Referring to FIG. 2, example device circuitry 160 of the printing device 100 is shown. The device circuitry 160 includes the heating apparatus 110 and the processor 120 (discussed above, in relation to FIG. 1), and a communication device 140, and a memory 150. In on example, the device circuitry 160 may include a user interface.

The processor 120 is communicatively coupled to the heating apparatus 110. In use, the processor 120 and the heating apparatus 110 calibrate the temperature sensor 116 (shown in FIG. 1) of the printing device 100. The calibration process is described below and a calibration loop of the printing device 100 is depicted in FIG. 3.

In use, the processor 120 determines the heating power of the heating apparatus 110. The heating power may be derived from a proxy measurement, such as a voltage, current, or frequency measurement. The processor 120 may determine the heating power continuously through operation of the printing device. In one example, the processor 120 may determine the heating power at a predetermined rate.

The calibration may occur during a simulation mode of the printing device 100.

The simulation mode of the printing device 100 is a mode in which printing conditions are simulated in the printing device 100 so that the printing device 100 operates in a manner that is different from its normal operation during printing. As an example, in the simulation mode at least one aspect of the operation of the printing device 100 is altered compared to the normal operation of the printing device 100 during printing.

Printing conditions may be simulated by variable effects associated with the printing device 100, such as print media, printing fluid, and print mode, not being engaged by the printing device 100 (that is, sterile conditions are used within the printing device 100). In another example, printing conditions may be simulated where at least one mechanical and/or electronic part of the printing device does not carry out the printing process (described in relation to FIG. 1). Alternatively, at least one mechanical and/or electronic component of the printing device 100 may operate according to the printing process (described in relation to FIG. 1) but without engaging any variable effects. In a further example, a subset of mechanical and/or electronic components of the printing device 100 may be temporarily disengaged (that is, paused) during the simulation mode of the printing device 100. In a variation, power may be supplied to a subset of mechanical and/or electronic components of the printing device 100 during the simulation mode of the printing device 100. In one example, the heating apparatus 110, processor 120, and temperature sensor 116 may remain switched on, whilst other components of the printing device 100 are not supplied with power and are therefore switched off. In one example, the temperature sensor 116 is a passive component so is not supplied with power.

As explained above, a simulation mode alters at least one aspect of the operation of the printing device 100 compared to the normal operation of the printing device 100 during printing. In one arrangement, the printing device 100 could be placed in a simulation mode and, as a result, the components of the printing device 100 associated with calibration of the temperature sensor 116 may operate as normal but at least one other component of the printing device 100 may operate in an altered way compared to normal printing operation. The at least one other component may be a component that is not used in the calibration process (a non-calibration component). In one example, the altered operation of the at least one other component may be a reduction of one or more of input power, current, and voltage to the one other component. As an example, the one other component may receive less power input compared to normal power input during printing.

Practically, the simulation mode is designed to be "as close as possible" to normal printing conditions yet removing variability so that the conditions of the printing device are sterile conditions.

In this way, accurate calibration of the temperature sensor 116 is achieved because the determined heating power of the heating apparatus 110 is representative of the heating power of the heating apparatus 110 during printing. Secondly, accurate calibration of the temperature sensor 116 is achieved because altered operation of non-calibration components results in a reduction of background noise within the printing device 100 that would otherwise cause inaccuracy in the determination of heating power by the processor 120. The background noise is a term that refers to those components of the printing process that vary during printing as a result of application specific demands from the printing device. Examples are media properties (for example, thickness and/or weight), number of printed colorants per sheet side, number of sheet sides printed (simplex or duplex), insertion of idle cycles, and coverage of the colorants, etc.

In addition, use of a simulation mode allows the same temperature sensor to be used to control the heating apparatus in a feedback loop and in calibration.

The reduction in noise resulting from the simulation mode increases the accuracy of the determined heating power and the subsequent calibration of the temperature sensor 116.

In one example, the printing device may monitor whether it is operating in a simulation mode, so that the calibration process can be initiated in response to a determination that the printing device is in the simulation mode. In another example, the simulation mode may correspond to the PAUSE mode of the printing device. In one example, the simulation mode or the PAUSE mode may be periodically entered by the printing device, as such, the calibration process of the printing device may be periodically performed.

In one example, the processor 120 checks that the printing device 100 is in a simulation mode before determining the heating power. The check may include querying the status of one or more components of the printing device, for example, querying the image development unit 104 to check that the printing fluid of the unit 104 will not be or is not engaged. In another example, the processor may query a power status of one or more components of the printing device 100.

In one arrangement, the processor 120 may trigger the simulation mode of the printing device 100.

In use, following the determination of the heating power, the processor 120 predicts a temperature of an image substrate 115 of the printing device 100 heated by the heating apparatus 100.

In one example, the processor 120 predicts the temperature of the image substrate 115 based on a predetermined correlation between temperature and heating power.

The processor 120 is communicatively coupled to a memory 150 of the device circuitry 160. The memory 150 contains computer readable storage medium 155 encoded with instructions for the processor 120. In addition, the memory 150 may store a predetermined correlation between temperature of an image substrate and heating power of a heating apparatus, such as heating apparatus 110. As an example, the predetermined correlation may be derived from historical temperatures and corresponding heating powers of the printing device 100.

In another example, the predetermined correlation may be calculated by the processor 120 using a theoretical heat model.

Additionally, or, alternatively, the predetermined correlation may be based on a relationship between heating power of a heating apparatus and temperature of an image substrate of at least one other printing device.

Accordingly, the printing device 100 may be connected via a network to at least one of the following: at least one other printing device, a central database associated with at least one other printing device, and a central database associated with a plurality of other printing devices.

In one arrangement, the printing device 100 is connected to such a network through a communication device, such as communication device 140 of the device circuitry 160.

In use, following the prediction, the processor 120 compares the predicted temperature to a measured temperature of the image substrate 115 by the temperature sensor 116. The measured temperature may be a set point temperature.

If there is a deviation between the predicted temperature and the measured temperature, the processor 120 determines a calibration offset.

The processor 120 then selectively generates a control signal for use in calibrating the temperature sensor 116 based on the calibration offset.

FIG. 3 depicts a calibration loop of the printing device 100 of FIGS. 1 and 2. The heating apparatus 110 has a heating controller 112 and a heating element 114. The heating controller 112 supplies a heating signal H to the heating element 114.

In response to the heating signal H, the heating element 114 applies heat to an image substrate 115. The temperature sensor 116 associated with the image substrate 115 converts a sensor input signal (for example incident Infra-Red energy) corresponding to an output temperature $T_o$, to a temperature feedback signal $T_f$ that is transmitted to the heating controller 112.

In another example of a feedback loop, a processor may determine the temperature feedback signal $T_f$ from the output temperature $T_o$ measured by the temperature sensor 116. In such a scenario, the processor may be an additional processor to processor 120 or may be processor 120. Alternatively, the determination of the temperature feedback signal $T_f$ from the output temperature $T_o$ may be implemented in hardware, for instance, in electronics.

The heating controller 112 modifies the heating signal H based on the temperature feedback signal $T_f$ and a temperature set point signal $T_s$. For example, the heating signal H may be modified to cause an increase or a decrease of the heating power of the heating apparatus 110. In one example, the heating signal H may be modified to cause an increase or decrease of heating power based on a difference between the respective temperatures corresponding to the temperature feedback signal $T_f$ and the temperature set point signal $T_s$.

During a simulation mode of the printing device 100, the heating signal H is probed by the processor 120, which receives a first input signal $I_1$. In one example, a sensor (not shown) may probe signal H and supply the first input signal $I_1$ to the processor 120, where the first input signal $I_1$ may be representative of the heating signal H or a characteristic (such as amplitude, frequency, voltage, current) thereof.

The processor 120 determines the heating power of the heating element 114 based on the first input signal $I_1$. In one example, the processor 120 may determine the heating power from a proxy, such as current, voltage or frequency of the first input signal $I_1$.

After the heating power is determined, the processor 120 predicts a temperature of the image substrate 115 based on the determined heating power.

The processor 120 compares the predicted temperature to a measured temperature of the image substrate 115 by temperature sensor 116. In this example, the temperature sensor 116 transmits a second input signal $I_2$ to the processor 120. The second input signal $I_2$ may be representative of the measured temperature of the image substrate 115.

As described above, if there is a deviation between the predicted temperature and the measured temperature, the processor 120 determines a calibration offset. The processor 120 then selectively generates a control signal S for use in calibrating the temperature sensor 116 based on the calibration offset. In this example, the control signal S is used to adjust the heating signal H produced by the heating controller 112. In this way, the processor 120 provides a supplementary corrective loop to the temperature feedback loop provided by the temperature sensor 116. Any calibration offset associated with the control signal S is added to the heating controller 112 output, that is driving the heating signal H. In this way, if the temperature sensor 116 was fixed or replaced the calibration offset would be automatically removed in the next calibration loop.

In another example, a deviation between the predicted temperature and the measured temperature may be used to modify the temperature feedback signal $T_f$.

In a variation, a further temperature sensor and a corresponding further feedback loop may be included in the printing device 100 of FIG. 1.

Figure 4:
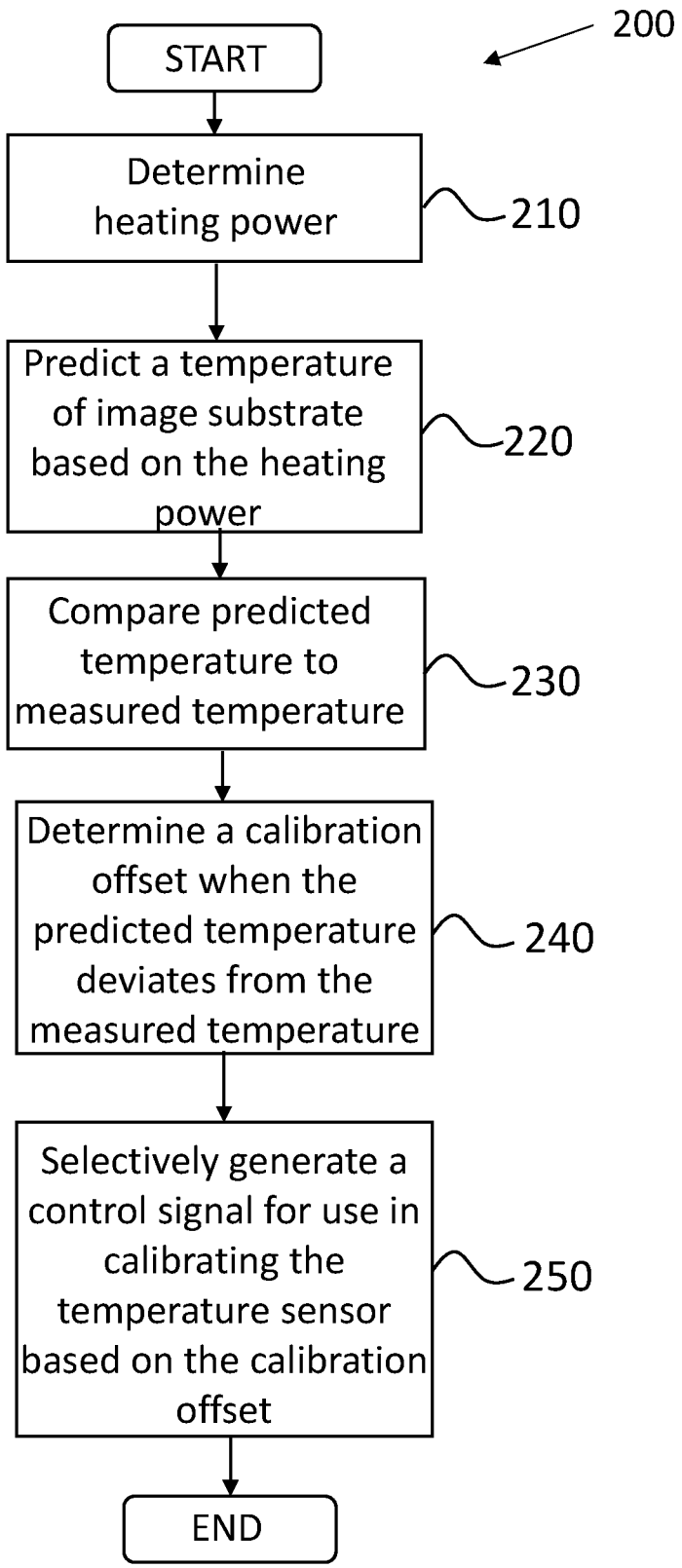
FIG. 4 is a flowchart of a method carried out by the printing device of FIGS. 1 and 2, according to an example.

Referring to FIG. 4, a computer-implemented method 200 carried out by the printing device 100 is depicted. The method 200 starts at block 210 where a heating power of a heating apparatus 110 of the printing device 100 is determined. In one example, the method 200 may start by determining that the printing device 100 is in a simulation mode or initiating a simulation mode in the printing device 100.

Next, at block 220, a temperature of an image substrate 115 heated by the heating apparatus 110 is predicted based on the heating power.

The method 200 proceeds to block 230 where the predicted temperature is compared to a measured temperature of a temperature sensor 116 associated with the image substrate 115 heated by the heating apparatus 110.

Following the comparison, at block 240 a calibration offset is determined based on a deviation between the measured temperature and the predicted temperature.

Finally, at block 250 a control signal is selectively generated for use in calibrating the temperature sensor 116 based on the calibration offset.

In one example, the method 200 may include causing the printing device 100 to exit the simulation mode.

In one example, the offset is not adjusted during printing to avoid negatively impacting continuity of the print conditions. Accordingly, the temperature sensor calibration is implemented outside of a printing mode of the printing device 100, such as for example in a simulation mode.

In one example, following the selective generation of a control signal for use in calibrating the temperature sensor 116 based on the calibration offset, additional adjustments of the printing device 100 may be carried out. For example, a color calibration procedure. The additional adjustments may be automatically initiated.

Figure 5:
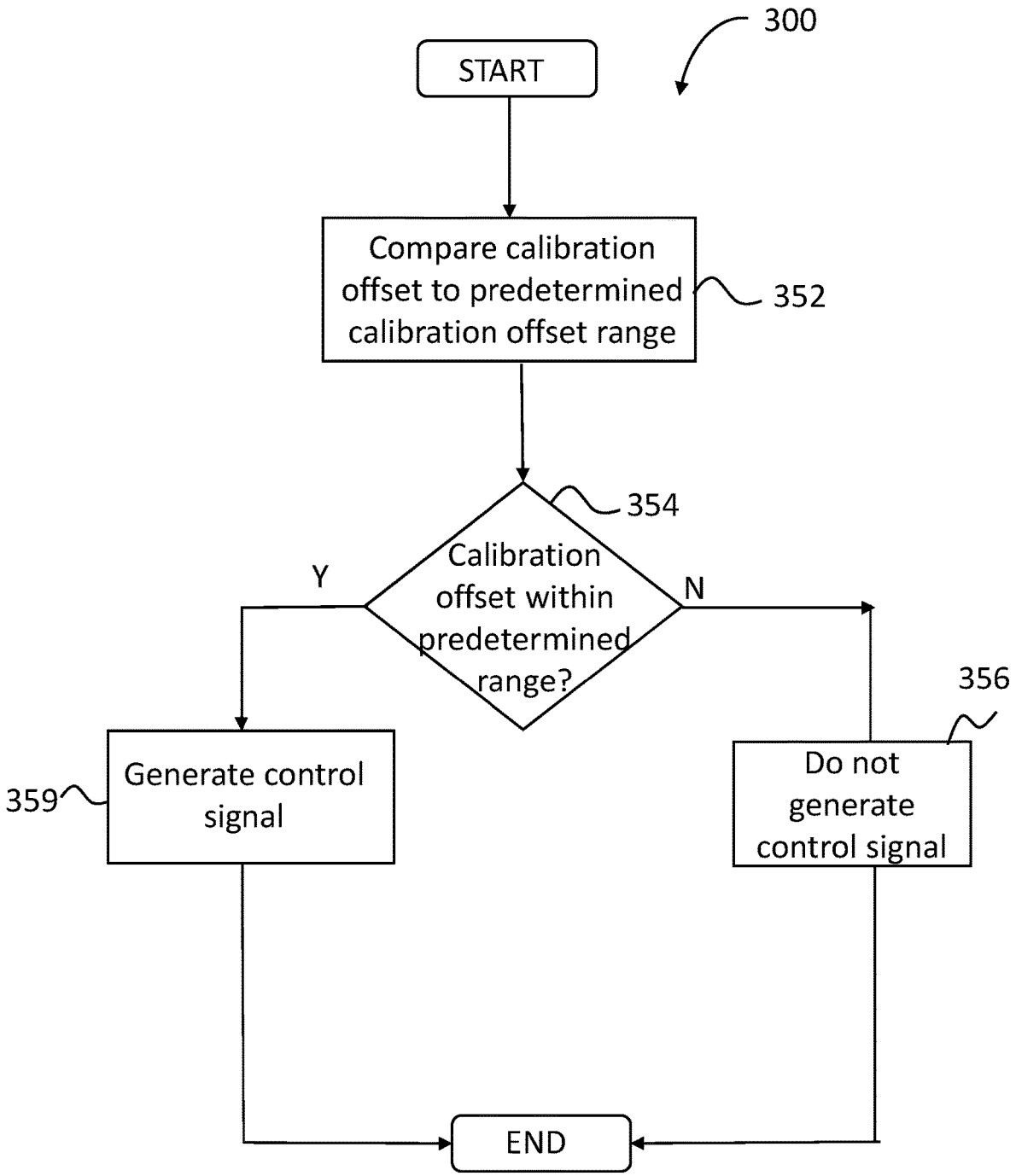
FIG. 5 is a flowchart of a method carried out by the printing device of FIGS. 1 and 2, according to an example.

Referring to FIG. 5, a further computer-implemented method 300 carried out by the printing device 100 is detected.

The method 300 describes the selective generation of the control signal for use in calibrating the temperature sensor 116 based on the calibration offset (block 250 of method 200). In this arrangement, the processor 120 carries out each of the method 200 and the method 300.

The method 300 starts at block 352 where a determined calibration offset is compared to a predetermined calibration offset range. The predetermined calibration offset range may account for expected variations in performance of the temperature sensor 116 throughout its lifetime. The predetermined calibration offset range may therefore be regarded as an expected range of calibration offsets to be applied to the temperature sensor, and thus, any offsets outside this range are indication of a significant issue with the printing device that would be tricky to overcome by calibration alone, without input by an engineer. As an example, the predetermined offset range may be a range of +−20 deg ° C. (Celsius).

Next, at block 354, a decision is made as to whether the determined calibration offset is within the predetermined offset range.

If the calibration offset is within the predetermined range, the calibration offset is an expected calibration offset and the method 300 follows the Y (yes) branch from block 354 to block 359. At block 359, a control signal is generated. As described in relation to FIGS. 3 and 4, the control signal is used to calibrate the temperature sensor 116 based on the calibration offset.

If the calibration offset is not within the predetermined range, the method 300 follows the N (no) branch from block 354 to block 356. At block 356, a control signal is not generated. In this instance, the method 300 follows the N (no) branch and the method 300 subsequently ends.

A calibration offset that exceeds the predetermined offset range is indicative of a significant malfunction of the temperature sensor 116 and a feedback signal is generated to a remote party as an escalated action to address a malfunction in the temperature sensor 116.

In one example, the predetermined offset range may be specific to the printing device. That is, the predetermined offset range may be personalized for the specific printing device. Although printing devices may be similar, the normal/abnormal offset range for each of them may be different (this may be due to learning of the device over time as the printing device operates or printing application specific impacts, etc.).

In one example, the predetermined calibration offset range may be determined based on component performance of at least one component of the printing device 100. In one example, data relating to component performance may be received by the printing device 100 from a central database via a network. In one example, the data relating to component performance may be historical performance data of the component. The historical performance data may be representative of the lifespan of the component in relation to heating power of a heating apparatus of the printing device. In this way, the data relating to component performance is specific to the printing device 100.

In one example, the predetermined calibration offset range may be determined based on a desired lifespan of the component, where the predetermined calibration offset range corresponds to a calibration offset range that allows the desired lifespan of the component to be reached.

In one example, the component relating to the component performance data may be the photo imaging plate 101 of the printing device 100.

Figure 6:
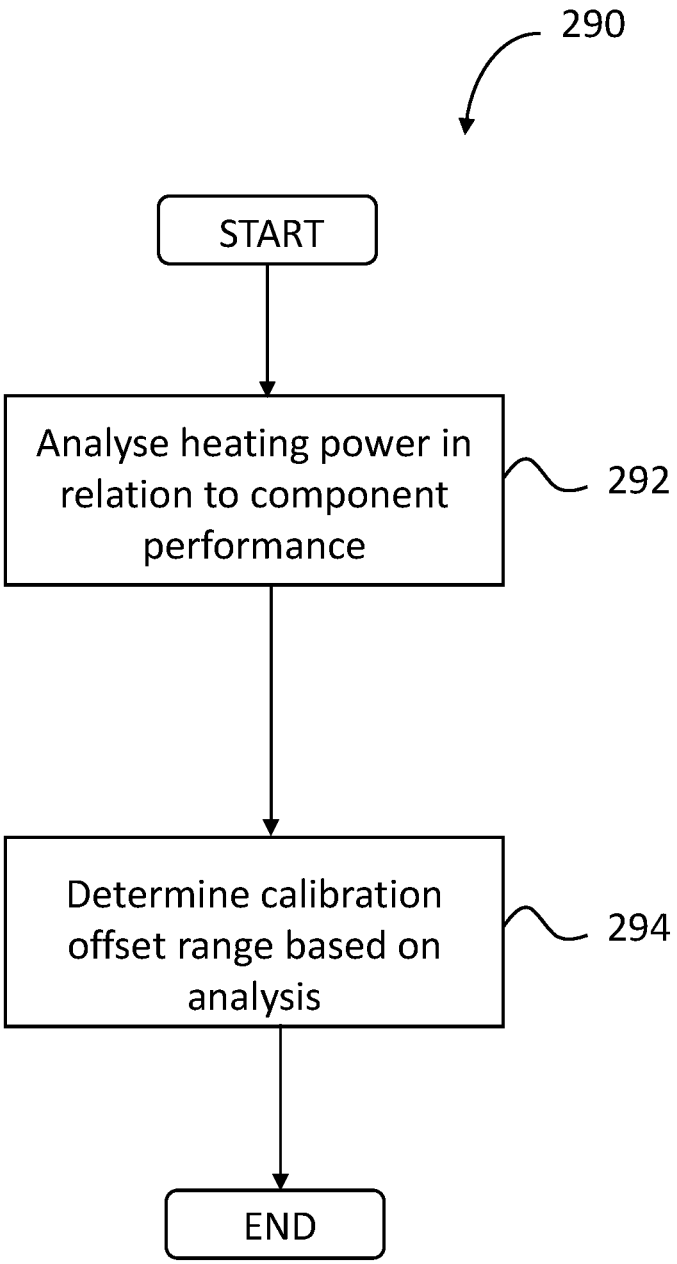
FIG. 6 is a flowchart of a method carried out by the printing device of FIGS. 1 and 2, according to an example.

FIG. 6 is a flowchart of an example computer-implemented method 290 carried out by the printing device 100. The method 290 is an example of how the predetermined calibration offset range, described in relation to FIG. 5, may be determined.

The method 290 starts at block 292 where the determined heating power (of block 210 of FIG. 4) is analyzed in relation to performance of a component of the printing device 100. In the analysis, a correlation may be determined between lifespan of the component and heating power. The printing device may be part of an installed base. Following the analysis, the method proceeds to block 294, where the predetermined calibration offset range is determined based on the analysis. The calibration offset range is representative of a range of deviations for which calibration is carried out. In one example, the predetermined calibration offset range may be determined based on a desired lifespan of the component, such that the range is set such that the component at least reaches a desired minimum lifespan. As explained in relation to FIG. 5, the predetermined calibration offset range is used to determine whether a control signal for use in calibrating the temperature sensor is generated. The method 290 may occur during a simulation mode of the printing device.

In one example, a correlation between heating power and component performance may be provided to the printing device from a central database over a network. In one example, the data relating to component performance may be historical performance data of the component. The historical performance data may be representative of the lifespan of the component in relation to heating power of a heating apparatus of the printing device. In this way, the data relating to component performance is specific to the printing device 100.

Figure 7:
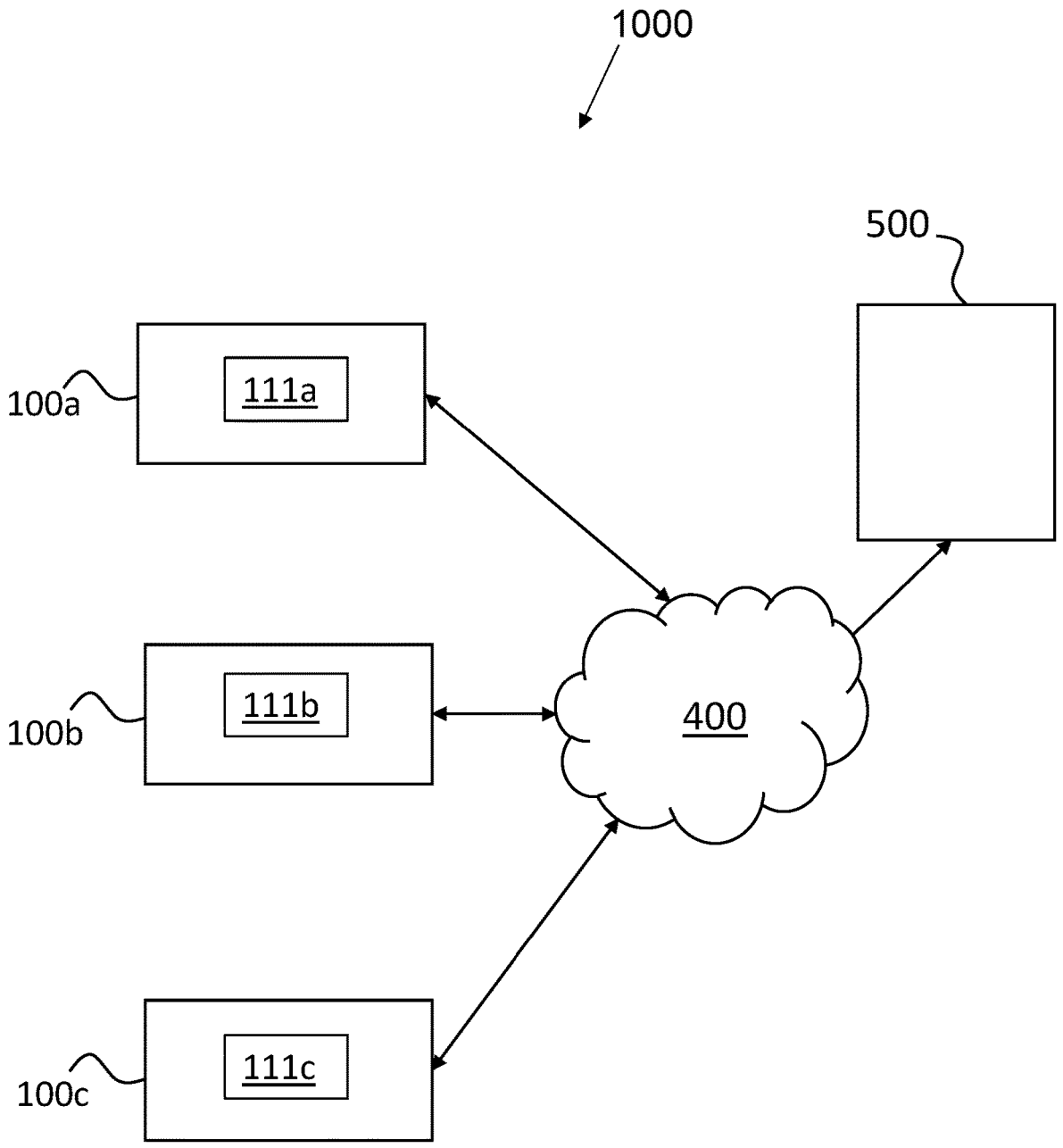
FIG. 7 is an illustration of a printer network, according to an example.

FIG. 7 depicts an example printer network 1000. A plurality of printing devices 100*a-c* is connected to a network 400. Each of the printing devices 100*a-c* may have a communication device that communicates with the network 400. In addition, the printing devices 100*a-c* are connected via the network 400 to a central database 500. The central database 500 may provide historical temperature and power ranges of each of the respective printing devices 100*a-c*. In this way, each printing device may calculate a predetermined power range or predetermined power offset range based on its own historical power range, and thus, its own usage history. Additionally, or alternatively, each printing device may calculate a predetermined calibration offset range based on historical power or calibration offset ranges of at least one other printing device, and thus, the usage history of at least one other printing device. Alternatively, each printing device 100*a-c* may have a processor that predicts a temperature using a theoretical model of a temperature-power correlation.

As discussed above, the memory 150 of the printing device 100 may store a computer readable storage medium 155 encoded with instructions executable by the processor 120. In the example of FIG. 7, each of the printing devices 100*a-c* stores (in a memory component corresponding to memory 150 and the computer readable medium 155 of device 100) instructions 111*a-c* that are executable by a processor to implement the previously described methods 200, 290, and 300.

The storage medium 155 may be any media that can contain, store or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random-access memory (RAM), a read-only memory (ROM), an erasable programmable read-only memory, or a portable disc.

The computer readable storage medium 155 may comprise: instructions to, during a simulation mode of a printing device, determine heating power of a heating apparatus of the printing device, instructions to, during a simulation mode of the printing device, predict a temperature of an image substrate of the printing device based on the heating power instructions to, during a simulation mode of the printing device, compare the predicted temperature to a measured temperature of the image substrate by a temperature sensor, instructions to, during a simulation mode of the printing device, determine a calibration offset when the measured temperature deviates from the predicted temperature, and instructions to, during a simulation mode of the printing device, generate a control signal for use in calibrating the temperature sensor based on the calibration offset.

In one example, the relationship from heating power to predicted temperature can be inverted. Thus, dependent and independent variables are interchanged. Conceptually, the calibration is to either offset heating power or to offset measured temperature. Offsetting the measured temperature is equivalent to offsetting the set point temperature. In one example, the simulation mode provides equivalence between the heating power and predicted temperature.

The reference to "printing device" used herein describes a plurality of components of a printer, where the plurality of components may be a subset of components of the overall printer.

In the preceding description, for purposes of explanation, numerous specific details of certain examples are set forth. Reference in the specification to "an example" or similar language means that a particular feature, structure, or characteristic described in connection with the example is included in at least that one example, but not necessarily in other examples.

The reference to "printing device" used herein describes a plurality of components of a printer, where the plurality of components may be a subset of components of the overall printer.

The above examples are to be understood as illustrative. It is to be understood that any feature described in relation to any one example may be used alone, or in combination with other features described, and may also be used in combination with one or more features of any other of the examples, or any combination of any other of the examples. Furthermore, equivalents and modifications not described above may also be employed.

The invention claimed is:

1. A printing device comprising:

a heating apparatus to heat an image substrate, the heating apparatus comprising a heater;

a temperature sensor associated with the image substrate; and a processor communicatively coupled to the heating apparatus;

wherein during a simulation mode of the printing device, the processor is to:

receive information based on probing a heating signal provided to the heating apparatus;

determine a heating power of the heating apparatus based on the information that is based on probing the heating signal provided to the heating apparatus;

predict a temperature of the image substrate based on the determined heating power;

compare the predicted temperature to a measured temperature of the image substrate as measured by the temperature sensor;

determine a calibration offset in response to a deviation of the measured temperature from the predicted temperature; and selectively generate a control signal for use in calibrating the temperature sensor based on the calibration offset.

2. The printing device of claim 1, wherein the processor is to predict the temperature of the image substrate based on a predetermined correlation between image substrate temperature and heating power.

3. The printing device of claim 2, wherein the predetermined correlation is based on a relationship between heating power of the heating apparatus and component performance of at least one component of the printing device.

4. The printing device of claim 1, further comprising a heating controller, wherein the heating power of the heating apparatus relates to the heating signal from the heating controller, and wherein the control signal is for use in calibrating the heating signal.

5. The printing device of claim 1, wherein the processor is to:

compare the calibration offset to a predetermined calibration offset range; and in response to the calibration offset being inside the predetermined calibration offset range, generate the control signal.

6. The printing device of claim 5, wherein in response to the calibration offset being outside the predetermined calibration offset range, the processor is to generate a feedback signal that causes feedback to be sent to a remote party associated with the printing device.

7. The printing device of claim 5, wherein the predetermined calibration offset range is based on performance of at least one component of the printing device.

8. The printing device of claim 1, wherein the processor is to check that the printing device is in the simulation mode.

9. The printing device of claim 1, wherein the processor is to trigger the simulation mode of the printing device.

10. A computer-implemented method comprising:

receiving, by a processor during a simulation mode of a printing device, information based on probing a heating signal provided to a heating apparatus;

determining, by the processor during the simulation mode, a heating power of the heating apparatus of the printing device, the determining of the heating power based on the received information that is based on probing the heating signal provided to the heating apparatus;

predicting, by the processor based on the heating power during the simulation mode, a predicted temperature of an image substrate heated by the heating apparatus;

comparing, by the processor during the simulation mode, the predicted temperature to a measured temperature of the image substrate from a temperature sensor;

determining, by the processor during the simulation mode, a calibration offset responsive to the measured temperature deviating from the predicted temperature; and selectively generating, by the processor during the simulation mode, a control signal for use in calibrating the temperature sensor based on the calibration offset.

11. The computer-implemented method of claim 10, comprising predicting the predicted temperature of the image substrate based on a predetermined correlation between image substrate temperature and heating power.

12. The computer-implemented method of claim 10, comprising:

comparing, by the processor, the calibration offset to a predetermined calibration offset range; and in response to the calibration offset being inside the predetermined calibration offset range, generating, by the processor, the control signal.

13. The computer-implemented method of claim 12, if comprising:

in response to the calibration offset being outside the predetermined calibration offset range, generating, by the processor, a feedback signal that causes feedback to be sent to a remote party associated with the printing device.

14. The computer-implemented method of claim 10, comprising checking, by the processor, that the printing device is in the simulation mode based on detecting that a component of the printing device is off.

15. A non-transitory computer readable medium comprising instructions that upon execution cause a system to:

during a simulation mode of a printing device;

receive information based on probing a heating signal provided to a heating apparatus;

determine, based on the information, a heating power of the heating apparatus;

predict a temperature of an image substrate of the printing device based on the heating power;

compare the predicted temperature to a measured temperature of the image substrate as measured by a temperature sensor;

determine a calibration offset in response to the measured temperature deviating from the predicted temperature; and generate a control signal for use in calibrating the temperature sensor based on the calibration offset.

16. The printing device of claim 1, wherein the temperature sensor is part of a temperature feedback loop in which a measurement from the temperature sensor is used in a control of the heating apparatus, and wherein the temperature sensor is further part of a calibration loop in which a measurement from the temperature sensor is to calibrate the temperature sensor.

17. The printing device of claim 16, further comprising:

a heating controller to provide the heating signal to the heating apparatus, wherein in the temperature feedback loop the heating controller is to modify the heating signal based on a measured temperature from the temperature sensor, and wherein in the calibration loop the processor is to provide the control signal to adjust the heating signal produced by the heating controller to calibrate the temperature sensor.

18. The printing device of claim 8, wherein the processor is check that the printing device is in the simulation mode based on detecting that a component of the printing device is disengaged or off.

19. The computer-implemented method of claim 10, wherein the temperature sensor is part of a temperature feedback loop in which a measurement from the temperature sensor is used in a control of the heating apparatus, and wherein the temperature sensor is further part of a calibration loop in which a measurement from the temperature sensor is to calibrate the temperature sensor.

20. The computer-implemented method of claim 19, wherein the heating signal is provided by a heating controller to the heating apparatus, the computer-implemented method further comprising:

in the temperature feedback loop, modifying, by the heating controller, the heating signal based on a measured temperature from the temperature sensor; and in the calibration loop, providing, by the processor, the control signal to adjust the heating signal produced by the heating controller to calibrate the temperature sensor.

* * * * *